US005473788A

United States Patent [19]

Aragona

[11] Patent Number: 5,473,788

[45] Date of Patent: Dec. 12, 1995

[54] FOOT SPONGE

[76] Inventor: Salvatore F. Aragona, 29302 Lund, Warren, Mich. 48093

[21] Appl. No.: 363,678

[22] Filed: Dec. 23, 1994

[51] Int. Cl.[6] ..... A47K 7/03

[52] U.S. Cl. ..... 15/104.92; 15/227; 15/244.4; 36/8.1

[58] Field of Search ..... 15/104.92, 244.1, 15/244.4, 227; 601/136; 36/8.1

[56] References Cited

U.S. PATENT DOCUMENTS

| | | | |
|---|---|---|---|
| 1,742,176 | 12/1929 | Hebig | 36/8.1 |
| 1,961,910 | 6/1934 | Pike | 36/8.1 |
| 2,852,793 | 9/1958 | Shelton | 15/106 |
| 3,299,540 | 1/1967 | Scholl | 36/8.1 |
| 3,359,572 | 12/1967 | Blackwell . | |
| 3,543,747 | 12/1970 | Gustafson | 15/104.92 |
| 3,548,439 | 12/1970 | Berst | 15/104.92 |
| 4,118,878 | 10/1978 | Semon | 36/8.1 |
| 4,520,525 | 6/1985 | Yogi et al. | 15/104.92 |
| 4,617,917 | 10/1986 | Miller | 15/161 |
| 4,918,779 | 4/1990 | Burns | 15/104.92 |
| 5,163,200 | 11/1992 | Carlin et al. | 15/104.92 |
| 5,177,829 | 1/1993 | Simpson | 15/104.92 |

OTHER PUBLICATIONS

Fluval Filter Package For 403/Foam (Art #A-693) of Rolf C. Hagen, Inc. Montreal, Quebec, Canada. Date unknown.

*Primary Examiner*—Edward L. Roberts, Jr.
*Attorney, Agent, or Firm*—Peter D. Keefe

[57] ABSTRACT

A foot sponge for providing cleansing of the feet includes a sponge member which provides a foot receptacle thereinside. The foot receptacle is characterized by an insole upon which a user's foot rests, a fore-foot receptacle into which the fore-foot of the user's foot is received, and preferably a heel receptacle for receiving the heel and ankle area of the user's foot. Preferably, the nose of the forefoot cavity is pre-soaped with a viscous liquid soap. The underside of the sponge member is flat and is connected with a base member having a plurality of uniformly distributed suction cups facing outwardly therefrom. In the preferred form of the foot sponge according to the present invention, the sponge member is composed of two parts, an outer component of a "dry" or "open cell" sponge material which provides the general shape and structural integrity to the foot sponge and an inner component of a "wet" or "closed cell" sponge material which provides a washing interface with the user's skin.

20 Claims, 2 Drawing Sheets

FOOT SPONGE

BACKGROUND OF THE INVENTION

1. Field of the invention:

The present invention relates to devices for providing washing of feet without the necessity of bending over to do so. More particularly, the present invention relates to a sponge having a cavity structured to receive a foot therein side for the purpose of cleaning the foot in a shower environment.

2. Description of The Prior Art

It is well known that difficulty and potential danger are involved with manual washing of a person's own feet while taking a shower. Not only is it a chore to bend over to accomplish manual foot washing, but the act of doing so involves a balancing act on the other foot which is at best less than safe, and for some potentially very dangerous. In spite of this, a person must nonetheless see to the proper hygiene of his or her feet, as they are frequently subject to becoming dirty and odoriferous.

In the prior art, there have been devised various devices for providing cleansing of the feet without the need for the person to bend over to perform washing by hand. Examples of such devices are disclosed in U.S. Pat. Nos. 2,852,793, 3,359,572, 3,543,747, 3,548,439, 4,520,525, 4,617,917, 4,918,779, 5,177,829, and 5,163,200. These exemplary devices operate in one way or another on a brush principle for providing cleansing of the foot, While brushes can adequately perform a cleansing task on many surfaces, brushes tend to be harsh when applied to soft skin. Further, soap may not be well retained over a long term with respect to the bristles, especially in a shower environment of use.

Accordingly, what is needed is a foot cleaning apparatus which eliminates the need to bend over, provides a soft yet effective cleansing action against the skin, and further affords sufficient soap retention to thereby permit multiple foot wash cycles.

SUMMARY OF THE INVENTION

The present invention is a foot sponge which eliminates any need of the user to bend over in order to wash his or her feet, provides a soft yet effective cleansing action against the skin, and further affords sufficient soap retention to thereby permit multiple foot wash cycles.

The foot sponge according to the present invention includes a sponge member which provides a foot receptacle therein side. The foot receptacle is characterized by an insole upon which a user's foot rests, a fore-foot receptacle into which the fore-foot of the user's foot is received, and preferably a heel receptacle for receiving the heel and ankle area of the user's foot. Preferably, a blind nose of the forefoot cavity is pre-soaped with a liquid soap. The underside of the sponge member is flat and is connected with a base member having a plurality of uniformly distributed suction cups facing outwardly therefrom.

In the preferred form of the foot sponge according to the present invention, the sponge member is composed of two parts, an outer component of an or "open cell" (also referred to as "dry") sponge material which provides the general shape and structural integrity to the foot sponge and an inner component of a "closed cell" (also referred to as "wet") sponge material which provides a washing interface with the user's skin.

In operation, the user presses the suction cups against a surface, such as a shower floor or bathtub, so that they become suctionally attached thereto. Thereafter, the person places his or her foot, toes first, into the foot receptacle and then wiggles his or her toes and squirms his or her foot therein to cause the soap resident thereat to foam and cleanse the foot as the skin rubs against the surfaces of the fore-foot receptacle. The heel and ankle area of the foot are also cleaned by the user's similarly rubbing and squirming his or her skin against the surfaces of the heel receptacle. The user may add additional soap to the foot receptacle wherever and whenever needed.

Accordingly, it is an object of the present invention to provide a foot sponge for cleaning a user's foot without having to bend over to do so.

It is an additional object of the present invention to provide a foot sponge for cleaning a user's foot without bending over, wherein the sponge thereof is wetted and pre-soaped.

It is a further object of the present invention to provide a foot sponge for cleaning a user's foot without bending over in a shower environment, wherein the sponge thereof is selectively soaped by the user.

It is another object of the present invention to provide a foot sponge for cleaning a user's foot without bending over in a shower environment, wherein the sponge thereof provides for cleaning of all the user's foot, inclusive of the toes, the heel and preferably around the ankle area.

It is yet another object of the present invention to provide a foot sponge for cleaning a user's foot without bending over in a shower environment, wherein the sponge has two components: an outer shape providing component and an inner cleansing component.

These, and additional objects, advantages, features and benefits of the present invention will become apparent from the following specification.

DETAILED DESCRIPTION OF THE PREFERRED EMBODIMENT

Figure 1:
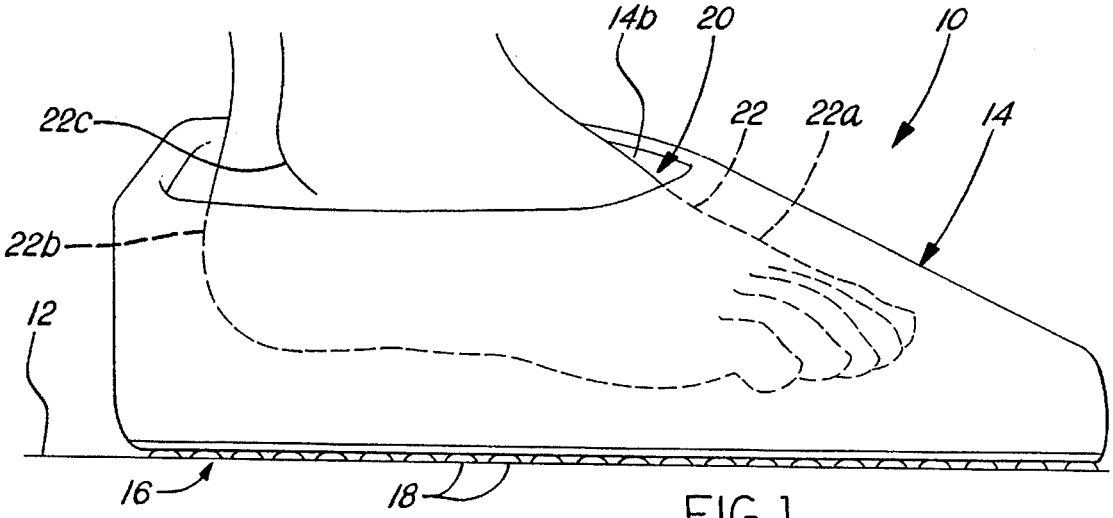
FIG. 1 is a side view of the foot sponge according to the present invention, shown in operation.

Referring now to the Drawing, FIG. 1 shows the foot sponge 10 according to the present invention in operation with respect to a surface 12. The surface 12 can be any surface, typically a shower floor or a bathtub. The foot sponge 10 includes a sponge member 14 and a base member 16 connected to the underside 14*a* of the sponge member (see FIG. 2). The base member 16 includes a plurality of suction cups 18 which suctionally engage the surface 12 to thereby restrain the foot sponge 10 from being unintentionally removed from, or slid in relation to, the surface. The sponge member 14 is provided with a foot receptacle 20 into which a user's foot 22 is inserted. The foot receptacle, as shown generally in FIG. 2, includes an insole 24 upon which the user's foot rests, a fore-foot receptacle 26 (which includes a portion of the insole) into which the fore-foot 22*a* of the user's foot 22 is received, and a heel receptacle 28 (which includes the remainder of the insole) into which the heel and ankle area 22*b* of the user's foot is received. Each of the user's feet are cleaned serially by placing one foot at a time into the foot receptacle 20 and then squirming his or her foot in relation to the sponge member 14, as will become clear from the detailed description which follows.

The sponge member 14 is composed of a sponge material, preferably a sponge material which retains its shape when wet. Externally, the sponge member 14 is characterized by a substantially flat underside 14*a*, an opening 14*b* opposite the flat underside, a nose 14*c* that tapers from the opening toward the underside, and a sidewall 14*d* which defines, in combination with the nose, the opening. The opening 14*b* extends into the sponge member and terminates at the insole 24.

The fore-foot receptacle 26 is in the form of a cavity formed in the nose 14*c* of the sponge member 14. The fore-foot receptacle 26 is defined by a forwardly extending continuation (in relation to the entry opening 14*b*) of the insole 24 which mates with a vault 26*a*, wherein the fore-foot receptacle 26 communicates with the opening 14*b*. The fore-foot receptacle 26 terminates in a blind nose 26*b*. The fore-foot receptacle 26 is dimensioned to accept the fore-foot 22*a* of an average size adult foot 22, wherein the toes of the user come close to, or gently into contact with, the blind nose 26*a*. However, the foot sponge 10 may be manufactured in a variety of sizes, whereupon the fore-foot receptacle size may be selected to fit a particular foot size or a range of foot sizes. While the vault 26*a* shown in the Drawing is of a generally U-shape which tapers toward the insole 24 with increasing proximity to the blind nose 26*b*, another selected shape is acceptable, such as for example a foot conforming shape.

Figure 2:
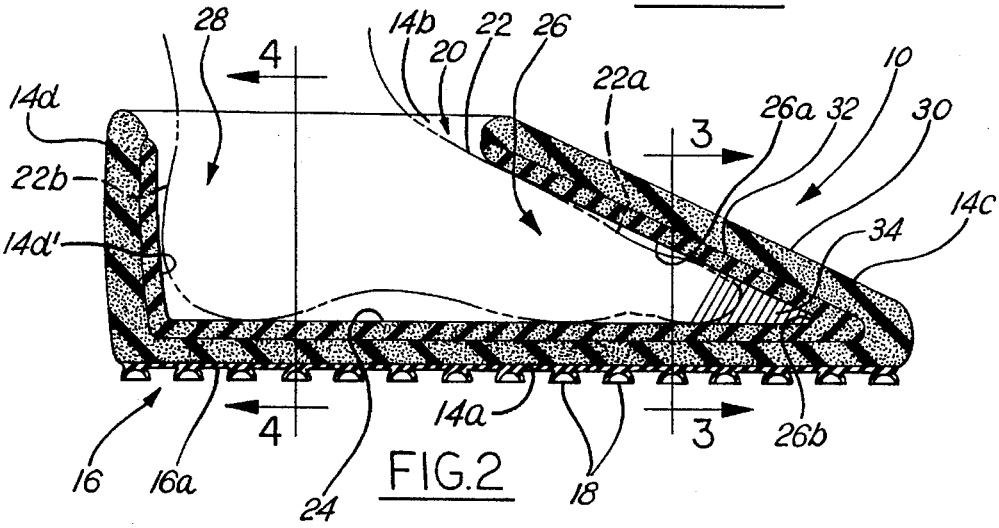
FIG. 2 is a partly sectional side view of the foot sponge according to the present invention.
Figure 3:
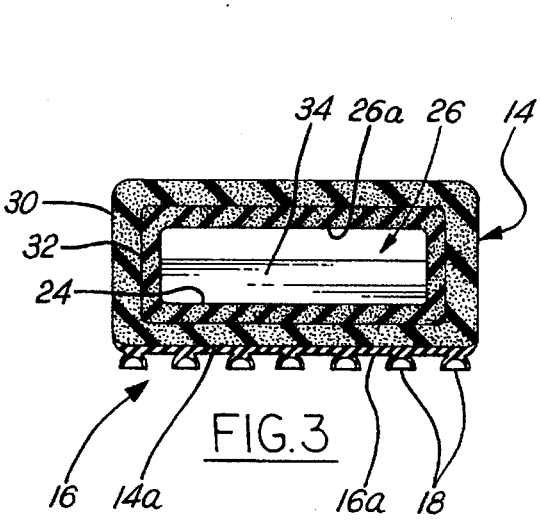
FIG. 3 is a partly sectional view of the foot sponge according to the present invention, seen along line 3—3 in FIG. 2.
Figure 4:
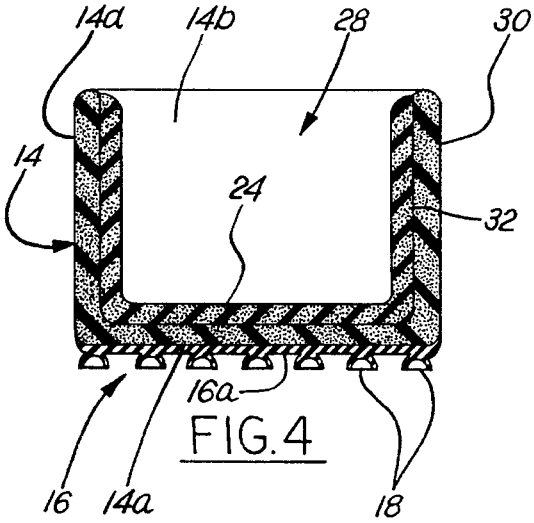
FIG. 4 is a partly sectional view of the foot sponge according to the present invention, seen along line 4—4 in FIG. 2.
Figure 5:
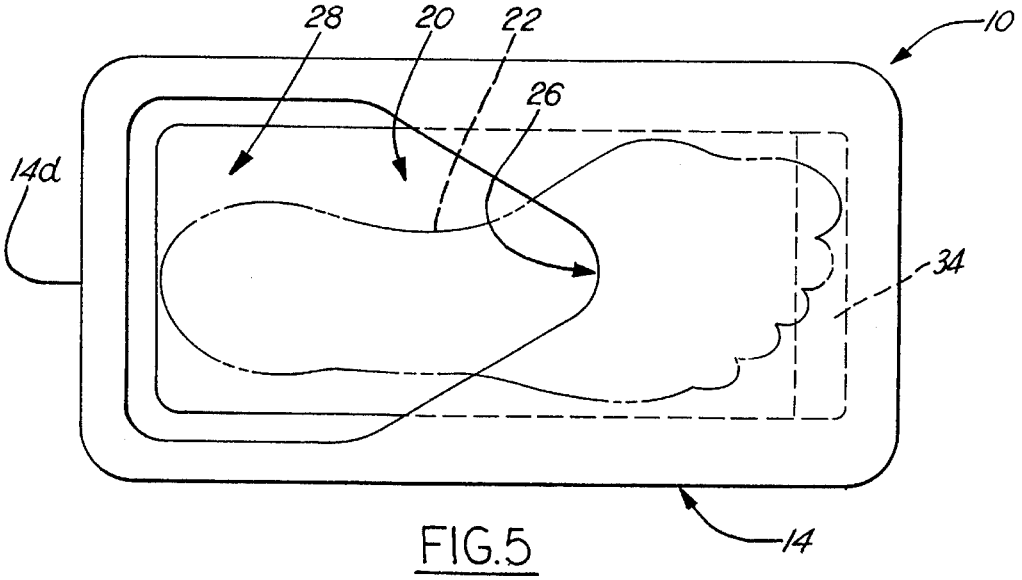
FIG. 5 is a top plan view of the foot sponge according to the present invention.

The heel receptacle 28 is located at the opening 14*b* and is defined by the sidewall 14*d* and a portion of the insole 24 exterior to the fore-foot receptacle 26. The sidewall 14*d* preferably extends from the insole 24 to the vicinity of the user's ankle 22*c*. The inside surface 14*d'* of the sidewall 14*d* is spaced from the blind nose 26*b* of the fore-foot receptacle 26 to thereby accommodate the length of the user's foot 22, as generally depicted in FIG. 2. While the heel receptacle 28 shown in the Drawing is of a generally U-shape, another selected shape is acceptable, such as for example a foot conforming shape.

A preferred spongy material of the sponge member 14 is an "open cell" (also referred to as "dry") cellulose foam material used conventionally for aquarium filtration, such as for example a FLUVAL brand foam sponge manufactured by Rolf C. Hagen, Inc., Montreal, Quebec, Canada. This material is a preferred example because it is able to keep its shape when wet.

As shown in the Drawing, it is preferred that the sponge member 14 be composed of two components: an outer component 30 and an inner component 32. The outer component 30 is composed of the aforementioned open cell cellulose foam material in that it has shape defining properties which cause the sponge member 14 to retain its shape when wet and to easily pass water therethrough. The inner component 32 is composed of a soft, "closed cell" (also referred to as "wet") cellulose foam material, such as for example that used ubiquitously for the application of facial powder cosmetics. The inner component 32 is preferably thinner than the outer component 30, as generally depicted in FIG. 2, as a thicker outer component helps to ensure preservation of shape of the foot sponge 10 when the sponge member 14 is wet. The outer and inner components 30, 32 are preferably each, respectively, of a single piece construction, and mutually interconnected, such as by a mechanical interfit or by an adhesive.

The base member 16 includes a base layer 16*a* composed preferably of a pliable elastomer material, such as rubber or plastic. The base layer 16*a* is connected with the underside 14*a* of the sponge member 14, as for example by an adhesive. As mentioned hereinabove, a plurality of suction cups 18 are substantially uniformly distributed across the base layer 16*a*, facing directly away therefrom. Preferably, the suction cups 18 are integrally formed with the base layer 16*a*. Preferably further, the suction cups 18 each have a cross-section that is small in relation to the area of the base layer, and further each does not unduly protrude from the base layer, so that when the suction cups suctionally engage the surface 12, the base layer is stable with respect to the surface, as generally indicated by FIG. 1.

It is preferred to provide a pre-soaped foot receptacle 20. In this regard, it is preferred to place a quantity of liquid soap 34 at the blind nose 26*b* of the fore-foot receptacle 26. A preferred liquid soap is one which has high viscosity and does not easily dissolve away when water is added thereto, such as for example a cream type hand cleaner liquid soap. A first example of a cream type hand cleaner liquid soap is manufactured by Gojo Industries, Inc. of Akron, Ohio (the composition being: paraffinic solvent, water, mineral oil, tallates, surfactant, propelen glycol, petroleum, allantoin, aloe extract, inositol, lanolin, methionine, preservative, vitamins A, B, C, E, and H, and wheat germ extract). A second example of a cream type hand cleaner liquid soap is manufactured under the trademarks DL, PERMATEX, FAST ORANGE by Loctite Corporation, Newington, Conn. (the composition being: water, d-limonene, pumice, biodegradable surfactant, castor oil, propylene glycol, triethanolamine, acrylic acid polymer, lanolin, methylchloroisothiazolinone, methylisothiazolinone, aloe vera, jojoba oil, and vitamin E). Other liquid soaps are acceptable. For example, conventional liquid soaps marketed for the cleaning of hands, particularly those having anti-bacterial properties are acceptable. In this regard, it is preferred for the entire foot sponge 10 to be sold in an air tight plastic wrap to ensure freshness of the liquid soap by the user. Pre-soaping may be either via a soap deposit in the cavity 20 and/or soap integrated with the cells of the sponge member 14.

Alternatively, or in addition to the pre-soaping described hereinabove, the user may squirt a conventional liquid soap into the cavity to attain the desired degree of soapiness of the sponge member 14.

Figure 6:
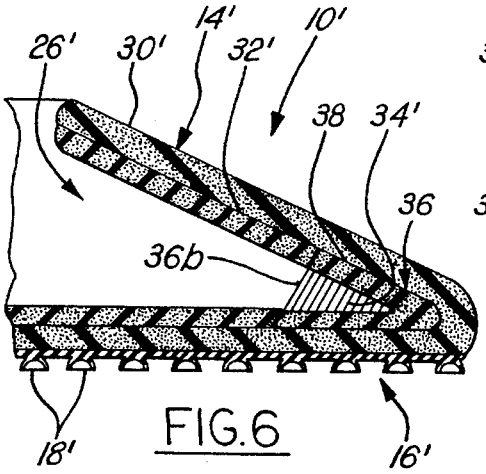
FIG. 6 is a partly sectional side view of a first modified form of the foot sponge according to the present invention, showing the fore-foot receptacle thereof having a soap cartridge.
Figure 7:
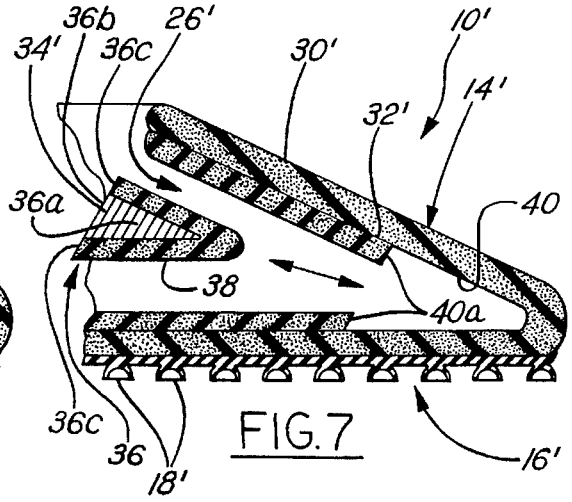
FIG. 7 is a partly sectional side view of the first modified form of the foot sponge according to the present invention, showing the fore-foot receptacle thereof having a soap cartridge being inserted therein or removed therefrom.

As shown in FIGS. 6 and 7, a first modified form of the foot sponge 10' incorporates a replacement soap cartridge 36 for periodically replenishing the liquid soap 34'. In this regard, the soap cartridge 36 is shaped to fit into the blind nose 26*b'* of the fore-foot receptacle 26'. The exterior of the soap cartridge 36 is composed of a sponge material 38 which is similar to, preferably the same as, the inner component 32'. A recess 40 is formed at the blind nose **26*b'* which provides an endwall 40*a*. In this regard, it is preferred to form the recess 40 by removing the inner component 32'. The soap cartridge 36 has an interior space 36*a* which is filled with the liquid soap 34', and is truncated to thereby form an aperture 36*b* and an endwall 36*c* in the sponge material 38. The soap cartridge 36 and the recess 40 are complementarily shaped so that when the soap cartridge is placed into the recess, as shown in FIG. 6, the endwalls 40*a* and 36*c* mutually abut, wherein the sponge material 38 abuts the outer component 30' and the aperture 36*b* opens into the fore-foot receptacle 26'. An air tight plastic wrap is provided around the soap cartridge in order to keep the liquid soap 34' therein fresh until it is ready for use by the user, whereupon the user removes it before insertion into the fore-foot receptacle 26'. A removable or easily breakable thin plastic membrane occluding the aperture 36*b* to prevent the liquid soap 34' from accidentally exiting the soap cartridge 36** during its installation may be provided.

Figure 8:
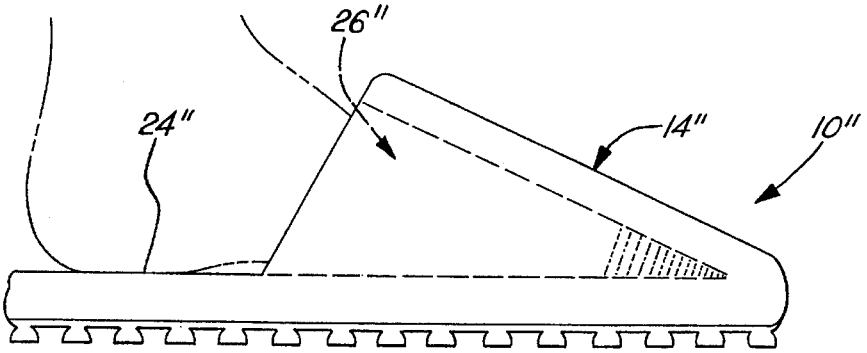
FIG. 8 is a side view of a second modified form of the foot sponge according to the present invention.

FIG. 8 depicts a second modified form of the foot sponge 10", wherein the heel receptacle referred to hereinabove is obviated. In this regard, the fore-foot receptacle 26" and the insole 24" remain essentially unaltered from that described hereinabove, but the sponge member 14" is modified wherein the sidewall **14*d*** referred to hereinabove is now eliminated.

In operation, the user places the base member down onto a selected surface and then presses thereupon to thereby cause the suction cups to suckingly engage the surface. The user then takes a shower in a normal manner. When it comes time to clean his or her feet, each foot is serially placed into the foot receptacle of the foot sponge. In each occasion, the toes of the user encounter the soap and by squirming and other natural foot movements, the sponge member 14 will become soaped generally. As the user moves his or her foot with respect to the sponge member, the skin of the foot is cleansed by action of the sponge member in conjunction with the water and the soap.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A foot sponge for providing cleansing of each foot of a person, each foot having a fore-foot that includes toes of the foot, a heel and an ankle, said foot sponge being used in conjunction with an application thereto of water, said foot sponge comprising:

a sponge member composed of a spongy material, said sponge member having an underside, said sponge member having a foot receptacle formed therein opposite said underside, said foot receptacle comprising:

an insole upon which a foot is restable; and fore-foot receptacle means including a portion of said insole for receiving thereinto the fore-foot of the foot; and base member means connected with said underside of said sponge member for providing a selectively removable attachment to a surface;

wherein said sponge member is wetted and each foot of a person are serially placed in said foot receptacle, wherein movement of the foot within said foot receptacle with respect to said sponge member provides cleansing of the foot; and wherein said sponge member comprises:

an outer component composed of an open cell cellulose material having shape retention when wet; and an inner component composed of a closed cell cellulose material said inner component lining said foot receptacle.

2. The foot sponge of claim 1, wherein said foot receptacle of said sponge member further comprises:

opening means adjoining said fore-foot receptacle means for providing an entry location into which the foot is placed into said foot receptacle; and a heel receptacle means formed at said opening means and including a second portion of said insole for receiving the heel of the foot including a selected portion of the foot between the heel and the ankle thereof.

3. The foot sponge of claim 1, wherein said base member means comprises:

a pliable base layer connected with said underside of said sponge member; and a plurality of suction cups distributed across said base layer for providing a selectively releasably sucking attachment to the surface.

4. The foot sponge of claim 1, further comprising soap selectively located in said foot receptacle.

5. The foot sponge of claim 4, wherein said fore-foot receptacle has a blind nose for receiving the toes of the foot; wherein further, said soap is a liquid soap selectively occupying a predetermined space at said blind nose.

6. The foot sponge of claim 5 further comprising soap cartridge means for replaceably providing said liquid soap at said blind nose.

7. The foot sponge of claim 2, wherein said foot receptacle of said sponge member further comprises:

opening means adjoining said fore-foot receptacle means for providing an entry location into which the foot is placed into said foot receptacle; and a heel receptacle means formed at said opening means and including a second portion of said insole for receiving the heel of the foot including a selected portion of the foot between the heel and the ankle thereof.

8. The foot sponge of claim 7, wherein said base member means comprises:

a pliable base layer connected with said underside of said sponge member; and a plurality of suction cups distributed across said base layer for providing a selectively releasably sucking attachment to the surface.

9. The foot sponge of claim 8, further comprising soap selectively located in said foot receptacle.

10. The foot sponge of claim 9, wherein said fore-foot receptacle has a blind nose for receiving the toes of the foot; wherein further, said soap is a liquid soap selectively occupying a predetermined space at said blind nose.

11. The foot sponge of claim 10, further comprising soap cartridge means for replaceably providing said liquid soap at said blind nose.

12. A foot sponge for providing cleansing of each foot of a person, each foot having a fore-foot that includes toes of the foot, a heel and an ankle, said foot sponge being used in conjunction with an application thereto of water, said foot sponge comprising:

a sponge member composed of a spongy material, said sponge member having an underside, said sponge member having a foot receptacle formed therein opposite said underside, said foot receptacle comprising:

an insole upon which a foot is restable;

fore-foot receptacle means including a first portion of said insole for receiving thereinto the fore-foot of the foot; and base member means for providing a selectively removable attachment to a surface, said base member means comprising:

a pliable base layer connected with said underside of said sponge member; and a plurality of suction cups distributed across said base layer for providing a selectively releasably sucking attachment to the surface;

wherein said sponge member is wetted and each foot of a person are serially placed in said foot receptacle, wherein movement of the foot within said foot receptacle with respect to said sponge member provides cleansing of the foot.

13. The foot sponge of claim 12 wherein said sponge member comprises:

an outer component composed of an open cell cellulose material having shape retention when wet; and an inner component composed of a closed cell cellulose material, said inner component lining said foot receptacle.

14. The foot sponge of claim 13, further comprising soap selectively located in said foot receptacle.

15. The foot sponge of claim 14, wherein said fore-foot receptacle has a blind nose for receiving the toes of the foot; wherein further, said soap is a liquid soap selectively occupying a predetermined space at said blind nose.

16. The foot sponge of claim 15, further comprising soap cartridge means for replaceably providing said liquid soap at said blind nose.

17. The foot sponge of claim 12, wherein said foot receptacle of said sponge member further comprises:

opening means adjoining said fore-foot receptacle means for providing an entry location into which the foot is placed into said foot receptacle; and heel receptacle means formed at said opening means and including a second portion of said insole for receiving the heel of the foot including a selected portion of the foot between the heel and the ankle thereof.

18. A foot sponge for providing cleansing of each foot of a person, each foot having a fore-foot that includes toes of the foot, a heel and an ankle, said foot sponge being used in conjunction with an application thereto of water, said foot sponge comprising:

a sponge member composed of a spongy material, said sponge member having an underside, said sponge member having a foot receptacle formed therein opposite said underside, said foot receptacle comprising:

an insole upon which a foot is restable;

fore-foot receptacle means for receiving thereinto the fore-foot of the foot, said fore-foot receptacle means having a blind nose;

entry means adjoining said fore-foot receptacle means for providing an entry location into which the foot is placed into said foot receptacle; and heel receptacle means formed at said entry means for receiving the heel of the foot including a selected portion of the foot between the heel and the ankle thereof;

soap cartridge means selectively located at said blind nose of said fore-foot receptacle means for providing soap at said blind nose, wherein said soap cartridge means comprises a portion of said fore-foot receptacle means; and base member means for providing a selectively removable attachment to a surface;

wherein said sponge member is wetted and each foot of a person are serially placed in said foot receptacle, wherein movement of the foot within said foot receptacle with respect to said sponge member provides cleansing of the foot.

19. The foot sponge of claim 18, wherein said soap cartridge means provides a liquid soap and is selectively replaceable at said blind nose.

20. The foot sponge of claim 18, wherein said base member means comprises:

a pliable base layer connected with said underside of said sponge member; and a plurality of suction cups distributed across said base layer for providing a selectively releasably sucking attachment to the surface.

* * * * *